US008522468B2

(12) United States Patent
Webber et al.

(10) Patent No.: US 8,522,468 B2
(45) Date of Patent: Sep. 3, 2013

(54) EASY CONNECT FOREND ASSEMBLY

(75) Inventors: Kevin A. Webber, Deerfield, NH (US); Sean P. Toner, Brookline, NH (US); Joseph A. Hoell, Jr., Dunbarton, NH (US)

(73) Assignee: O.F. Mossberg & Sons, Inc., North Haven, CT (US)

( * ) Notice: Subject to any disclaimer, the term of this patent is extended or adjusted under 35 U.S.C. 154(b) by 351 days.

(21) Appl. No.: 12/948,048

(22) Filed: Nov. 17, 2010

(65) Prior Publication Data

US 2011/0119982 A1 May 26, 2011

Related U.S. Application Data

(63) Continuation-in-part of application No. 11/551,271, filed on Oct. 20, 2006, now abandoned.

(60) Provisional application No. 60/729,145, filed on Oct. 20, 2005.

(51) Int. Cl.
*F41C 23/16* (2006.01)

(52) U.S. Cl.
USPC ..... 42/75.03; 42/17; 42/71.01

(58) Field of Classification Search
USPC ..... 42/14, 16, 17, 71.01, 71.02, 75.01, 42/75.03; 89/1.42
See application file for complete search history.

(56) References Cited

U.S. PATENT DOCUMENTS

| | | | | | |
|---|---|---|---|---|---|
| 157,699 | A | * | 12/1874 | Scott | 42/75.04 |
| 1,029,374 | A | * | 6/1912 | Kremer | 42/75.04 |
| 1,277,002 | A | * | 8/1918 | Van Name | 42/71.01 |
| 2,538,173 | A | * | 1/1951 | Swebilius | 42/16.1 |
| 2,679,123 | A | * | 5/1954 | Williams | 42/75.02 |
| 2,825,170 | A | * | 3/1958 | Simmons | 42/75.01 |
| 3,242,608 | A | * | 3/1966 | Heppard | 42/71.01 |
| 3,961,436 | A | | 6/1976 | Hagen et al. | |
| 4,063,379 | A | | 12/1977 | Ruger | |
| 4,328,633 | A | | 5/1982 | Pachmayr | |
| 4,406,080 | A | * | 9/1983 | Badali | 42/75.01 |
| 4,777,754 | A | * | 10/1988 | Reynolds, Jr. | 42/117 |
| 5,173,564 | A | | 12/1992 | Hammond, Jr. | |
| 5,305,539 | A | | 4/1994 | Von Kuster | |
| 5,711,102 | A | | 1/1998 | Plaster et al. | |
| 6,374,528 | B1 | * | 4/2002 | Davis et al. | 42/71.01 |
| 6,622,412 | B1 | | 9/2003 | Wilkes | |
| 6,655,069 | B2 | * | 12/2003 | Kim | 42/114 |
| 6,874,269 | B2 | | 4/2005 | Chen et al. | |

(Continued)

FOREIGN PATENT DOCUMENTS

| | | |
|---|---|---|
| EP | 2017566 | 1/2009 |
| WO | WO2009031998 | 3/2009 |

*Primary Examiner* — Gabriel Klein
(74) *Attorney, Agent, or Firm* — Donald S. Holland, Esq.; Holland & Bonzagni, P.C.

(57) ABSTRACT

A method and apparatus are disclosed for substituting a different forend assembly in a long gun (e.g., a shotgun) without the use of tools by a user in the field. Applicants' preferred apparatus for substituting a forend comprises: a modified forend carrier that is affixed to the long gun (e.g., the illustrated shotgun); a forend; and tool-less means for removably attaching the forend onto the carrier, or removing the forend off the carrier, without the use of tools, wherein the tool-less means comprises: (i) a tongue-and-groove arrangement in the forend and carrier, and (ii) a releasable lock contained, at least in part, in the carrier. This permits the forend to be swapped out.

11 Claims, 8 Drawing Sheets

(56) References Cited

U.S. PATENT DOCUMENTS

| | | | | |
|---|---|---|---|---|
| 6,889,463 | B2 | 5/2005 | Orth | |
| 7,162,823 | B2 | 1/2007 | Schoppman et al. | |
| 2006/0010748 | A1 * | 1/2006 | Stoner et al. | 42/71.01 |
| 2007/0089347 | A1 | 4/2007 | Webber et al. | |
| 2007/0137087 | A1 * | 6/2007 | Florea et al. | 42/90 |

* cited by examiner

EASY CONNECT FOREND ASSEMBLY

RELATED APPLICATIONS

This is a continuation-in-part application of U.S. Utility patent application Ser. No. 11/551,271, filed Oct. 20, 2006 now abandoned, which was based upon a U.S. Provisional Patent Application Ser. No. 60/729,145, filed Oct. 20, 2005 ("Applicants' provisional application"). Applicants hereby claim under 35 U.S.C. §§119(e), 120 the benefit of priority from those prior applications. Applicants hereby incorporate the disclosures of those prior applications by reference in their entireties.

FIELD OF INVENTION

This invention relates generally to firearms. More specifically, it relates to forends in long guns, such as shotguns.

BACKGROUND

A long gun is a firearm with an extended barrel, usually designed to be fired braced against the shoulder. Barrels of such weapons commonly extend to around 50 cm or longer, giving considerable accuracy and range. Most modern long guns fall into one of two categories, rifles or shotguns, distinguished by their design and type of projectile they fire.

Shotguns are designed primarily to fire small pellets, called shots. Some shotguns can be adapted to fire a single projectile, called a slug.

There are several major components of shotguns: the barrels, stocks, and forends or forearms. Shotguns are distinguished by the length of their barrels, and by their barrel diameters, or bores. The barrels, stocks, and forends vary according to the gun's design and intended use.

By far the most common gauges for barrels are 12 (0.73 in, 18.5 mm diameter) and 20 (0.614 in, 15.6 mm), although 4, 8, 10, 14, 16, 24, 28, 32 gauges and the .410 calibre (10 mm) have also been produced.

Chokes on the barrels can control the exiting spread, or pattern of shot. Therefore, shotgun gauges and choke patterns are selected based on the type of shooting to be done.

The proper fit for a user of a shotgun depends largely on the length and shape of the gun's stock. The selection of the proper stock and forend will have a bearing on the user's comfort, accuracy, and control when shooting.

The gauge of a barrel and the type of game are factors in determining what ammunition is to be used. Pump shotguns intended for private defensive use have barrels as short as 18 inches. "Small game" barrels, for hunting game like rabbits and squirrels with buckshot, are often 22 to 24 inches in length. Larger barrels, about 28-29 inches, are used to hunt quails, pheasants, and doves in semi-open wooded or farmland, where dense brush is less of a hindrance and the ability to have more reach is important. Still other barrels, designed for single shot, are used for hunting larger game.

The advent of interchangeable barrels made the shotgun a more versatile firearm, especially in the field. Hunters often swap out barrels for different game.

Shotguns also are used for sports such as skeet, trap, and sporting clays. These involve shooting clay disks, known as clay pigeons, thrown in various ways. Shorter stocks are used for greater maneuverability.

Often, shooters will want to change the forend and/or stock to create the proper fit. This happens, sometimes, when there are two shooters (e.g., a husband and wife) sharing the same shotgun. One of the shooters will, more than likely, have an improper fit with the shotgun.

Another instance is with hunters. Often, the hunter will want to switch out the forend and stock to create the proper fit for different game or sporting activity.

Changing the stock or forend, or both, is a time-consuming process. The user has to disassemble portions of the shotgun by using tools when in the field.

The average woman typically uses a shorter stock than the average man. Forearms have an ergonomic design for comfort, fit and control. Shotgun stocks and forends come in a variety of designs and materials. Selections of the stock and forend will depend upon what the shooter is comfortable with and the use.

Forends currently are either slid onto the magazine tube or over both the magazine tube and barrel. Some shotgun designs have a screw or another form of locking mechanism for the forend. In such instances, the shooter typically has to use a tool to swap out forends. For example, the shooter has to remove Philips head screws with a screwdriver. Once the forends are swapped, the screwdriver is reused to put the screws back. Sometimes, a shooter loses a screw and has to search for it.

Accordingly, it is a general object of the present invention to provide an improved method and apparatus which permit the quick and easy change of shotgun forends without the use of tools in the field.

It is another general object to provide an improved connect/disconnect system which permits the quick and easy change of forends, for any long gun, without the use of tools in the field.

It is another specific object to provide an easy connect/disconnect system for long-gun forends that permits a shooter to attach a different forend without the use of tools.

SUMMARY OF INVENTION

An easy connect/disconnect apparatus is disclosed for replacing a forend (a.k.a. forearm) in a long gun without the use of tools in the field. Applicants' preferred forend is spring-biased and can be mounted or replaced by a pushbutton release. In the preferred embodiment, Applicants' preferred apparatus comprises: (a) a long gun having a fixed forend carrier; (b) a forend; and (c) a tool-less means for removably attaching the forend onto the carrier and, if desired, later removing the forend off the carrier, without the use of tools, wherein the release means comprises: (i) a tongue-and groove arrangement in the forend and carrier; and (ii) a releasable lock contained, at least in part, within the carrier.

Applicants' preferred method comprises: (a) attaching a forend onto a fixed forend carrier of a long gun by a tongue-and-groove arrangement in the carrier and forend; (b) removably securing the forend, in place, to the carrier by a releasable lock located, at least in part, in the carrier; and (c) wherein steps (a) and (b) are performed without the use of tools by a user in the field.

BRIEF DESCRIPTION OF DRAWINGS

The above and other objects will become more readily apparent when the following description is read in conjunction with the accompanying drawings, in which.

DETAILED DESCRIPTION OF THE PREFERRED EMBODIMENTS

Figure 1:
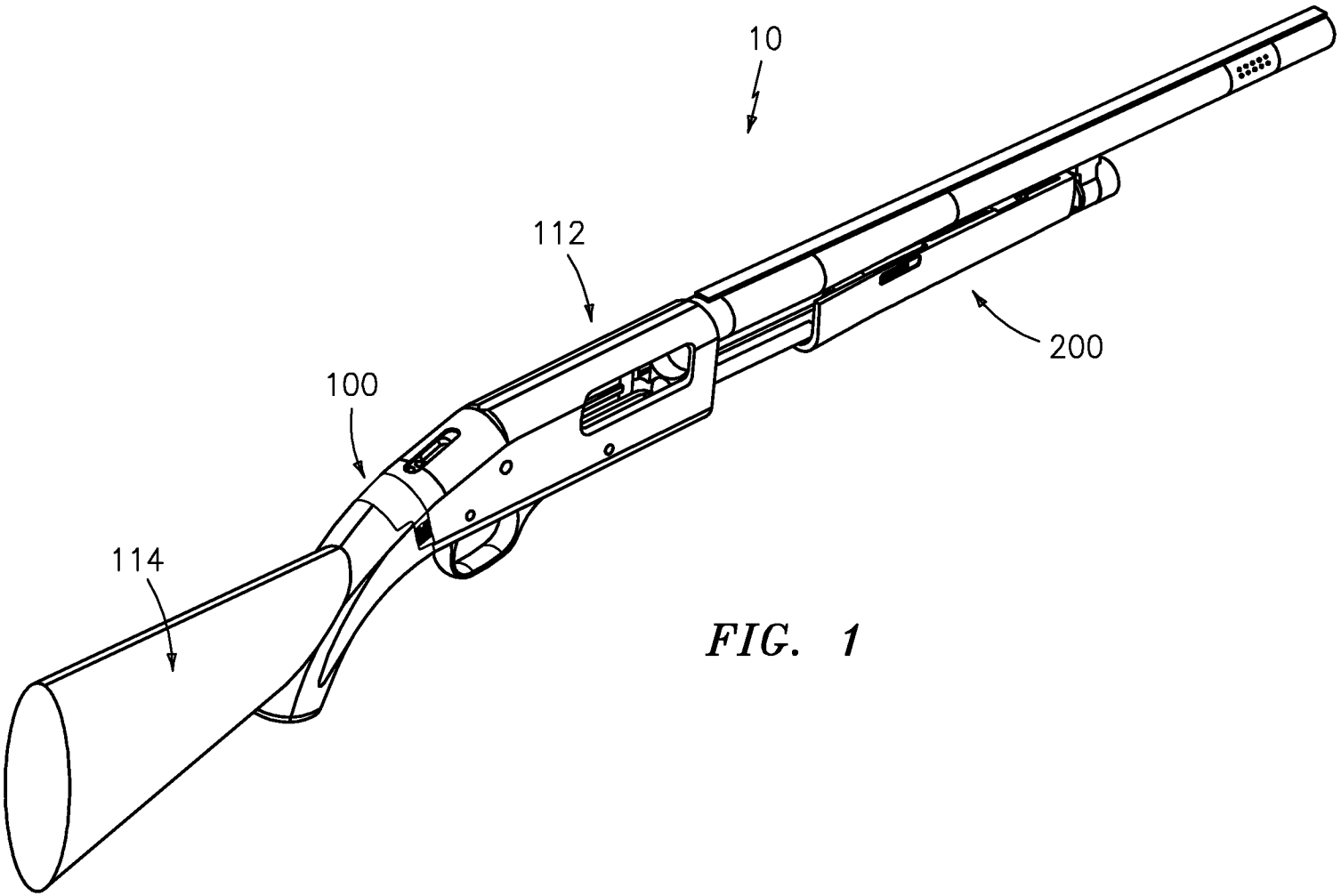
FIG. 1 shows a long gun (here, a pump shotgun) modified with Applicants' alternate embodiment of the "Easy Connect Forend Assembly"

Applicants have a pending U.S. patent application Ser. No. 11/551,271, entitled "EASY CONNECT STOCK AND FOREND SYSTEM", and filed Oct. 20, 2006. That "parent" application, published as U.S. Patent Application Publication No. 2007/0089347, discloses a prior model. The current application depicts both the prior forend model and an improved forend embodiment. O.F. Mossberg and Sons, Inc. ("Mossberg") is the Assignee of both applications.

FIGS. 1-4 illustrate the prior embodiment 200 of Applicants' "Easy Connect Forend Assembly", shown in the parent application, for easily connecting and disconnecting a forend in a long gun (e.g., shotgun 10), without the use of tools in the field. Applicants consider that to be an alternate embodiment.

FIGS. 5, 5A, 6, 7, 8, 9, 10, 11 illustrate Applicants' now-preferred embodiment 300.

Both of Applicants' "Easy Connect Forend" embodiments 200, 300 (in their broadest sense) are designed for use on any long gun, such as a rifle or shotgun. They are shown being used on a pump shotgun.

Applicants' two embodiments 200, 300 share similar structure to some extent. Like elements in the now-preferred embodiment 300 carry the same reference numbers but with the "prefix" 300, rather than the "prefix" 200. For example, the forend carrier 212 is labeled 312.

O.F. Mossberg & Sons, Inc., which manufactures the MOSSBERG® 500® pump shotguns, is the Assignee of the current invention. As used herein, the term "standard" refers to parts found in a MOSSBERG 500® shotgun; the term "modified" refers to parts changed from those found in a 500® shotgun.

FIG. 1 shows a MOSSBERG® 500® pump shotgun 10 with the "Easy Connect Stock and Forend System" described in Applicants' parent application. It contains the alternate embodiment 200.

FIG. 1, for the sake of completeness, also shows Applicants' "Easy Connect Stock" embodiment 100, from the parent application, for easily connecting and disconnecting a stock 114 to a receiver 112 in a long gun (e.g., shotgun 10), without the use of tools in the field.

Figure 2:
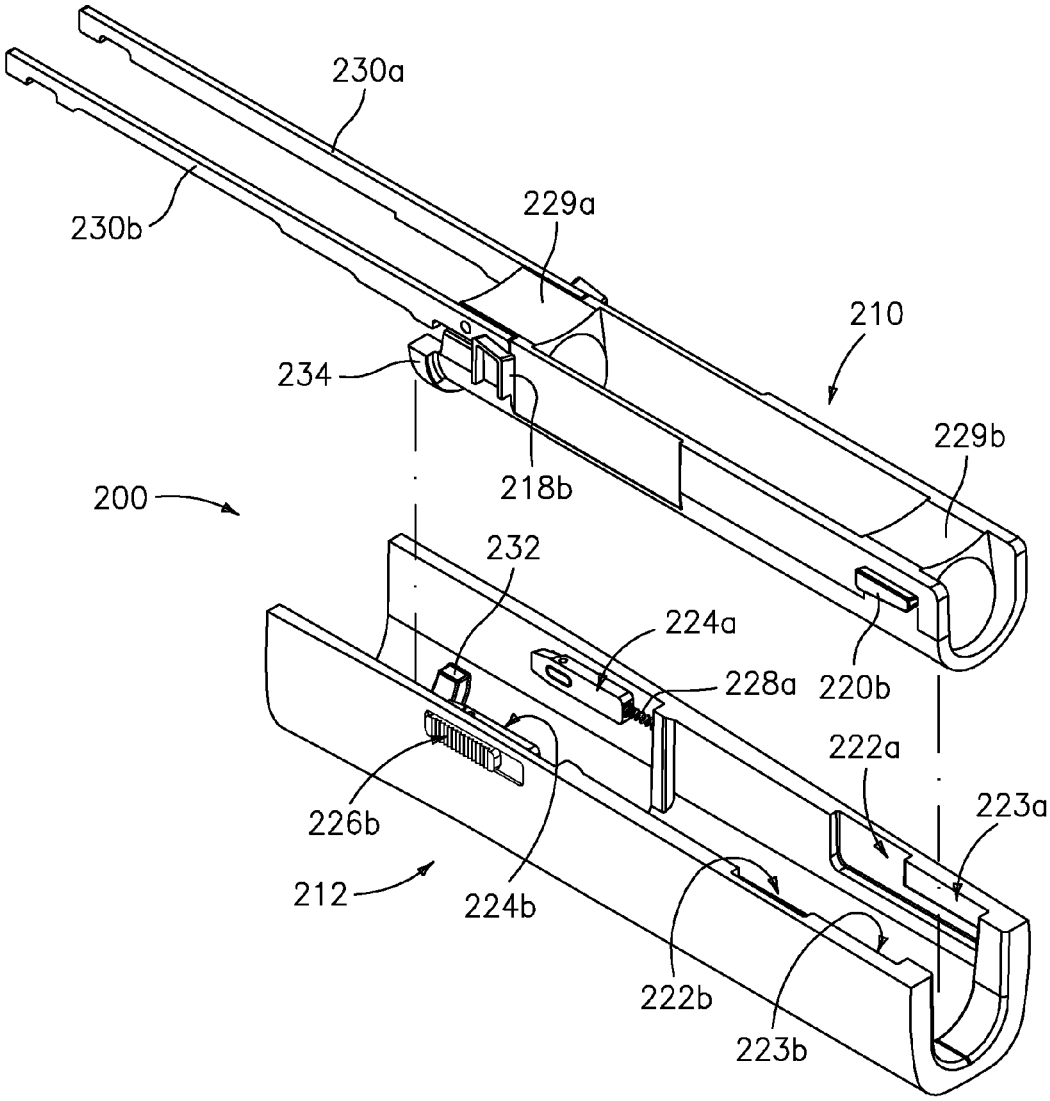
FIG. 2 is an exploded view of the forend carrier and forend forming the alternate "Easy Connect Forend Assembly", with action bars attached to the carrier.
Figures 3, 4:
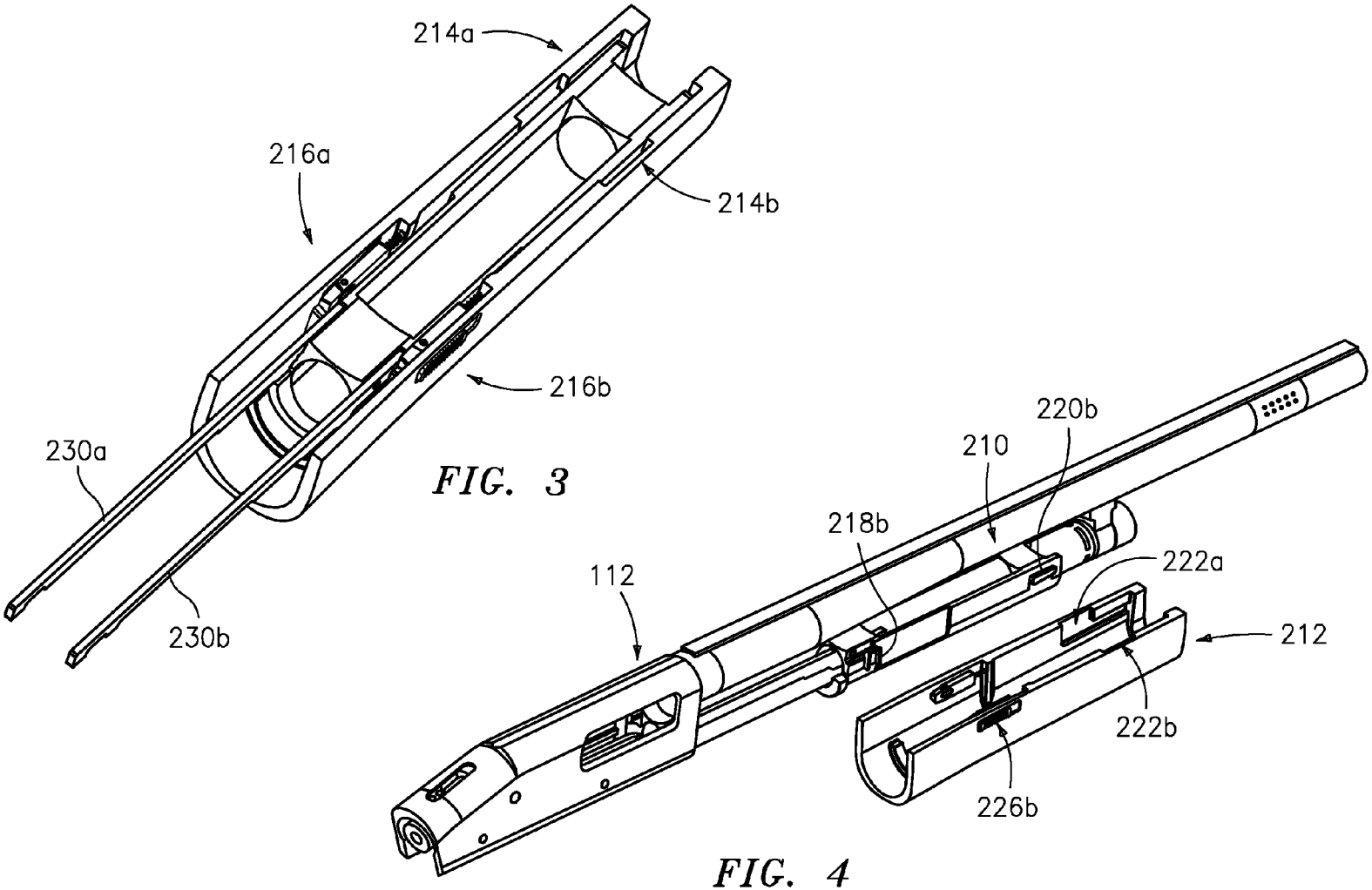
FIG. 3 is a top perspective view of the alternate carrier and forend assembly, nested together.
FIG. 4 is a perspective view of that forend carrier affixed to the front end of a shotgun, with the forend removed.

FIGS. 2-4 best disclose Applicants' alternate "Easy Connect Forend Assembly" 200. Assembly 200 comprises: a forend or forearm carrier 210 secured to the receiver assembly 112 (see FIG. 1); a modified forend or forearm 212 removably attachable to the forend carrier 210 by two front locks (e.g., two tongue-and-groove arrangements) 214*a*, 214*b*; and a pair of rear locks (e.g., two slide locks) 216*a*, 216*b* to removably lock the forend 212 onto the carrier 210.

Forend carrier 210 is a modified version of O.F. Mossberg & Sons, Inc.'s standard carrier for its 500® pump action shotgun. The modifications are best shown in FIG. 2: two identical rear lock protrusions (e.g., one shown at 218*b*) located on opposite sides of the carrier, near its rear; and two identical front lock protrusions (e.g., one shown at 220*b*) on opposite sides of the carrier, near its front.

Rear lock protrusions (e.g., 218*b*) have flat tops and exposed sides. The tops are tipped forward. They decline from rear to front.

Front lock protrusions (e.g., 220*b*) resemble the human tongue, but are flat on their exposed sides. They are generally flat on top; have flat bottoms which incline from rear to front; and, have a rounded tip.

Applicants' forend (a.k.a. forearm) 212, as mentioned above, is a modified version of O.F. Mossberg & Sons, Inc.'s standard forend for its 500® pump action shotgun. As best shown in FIG. 2, the modifications are: two identical L-shaped pockets 222*a*, 222*b* inside the forend (one on each side), which form two identical front "pocket" protrusions 223*a*, 223*b* (one on each side) at the leading edge of the forend, are designed to slip off or snugly onto the front lock protrusions (e.g., 220*b*); and two spring-biased slide bars 224*a*, 224*b* inside the forend (one on each side), with attached slide lock releases (e.g., one shown at 226*b*) outside of the forend, are designed to slide off or snugly onto the tops of rear lock protrusions (e.g., 218*b*).

Forend lock springs (e.g., one shown at 228*a*) normally bias respective slide bars 224*a*, 224*b* into a locked position (see FIG. 2). In that position, rear ends of the bars ride onto the carrier's rear lock protrusions (e.g., 218*b*). Because of a tight fit, the bars stay in place until the knurled slide releases (e.g., 226*b*) are pushed forward, thereby sliding the bars 224*a*, 224*b* forward and off the protrusions (e.g., 218*b*).

Paragraph [0067] in the parent application talks about "hollow spacers 229*a*, 229*b*" (see present FIG. 2). The description of those parts is inaccurate. Parts 229*a*, 229*b* are an integral part of the carrier geometry and actually provide the bearing blocks which support the carrier assembly 210 on the magazine tube 384. One bearing block 229*a* is located just rear of the slide bars 224*a*, 224*b*; the other bearing block 229*b* is just rear of L-shaped pockets 222*a*, 222*b*.

FIGS. 2 and 3 show standard actions bars 230*a*, 230*b* attached to the forend. They form no part of this invention.

There are two vertical stops (e.g., one shown at 232) on the front and rear ends of the carrier 210. They are located on the bottom of carrier 210. As the action is closed, the forend 212 pushes on rear stop 232. As the action is opened, the forearm pushes on the front stop.

To attach the forend or forearm 212, slide the rear of the forend over the carrier's front lock protrusions (e.g., 220*b*). Continue pushing forward until the carrier's front lock protrusions slip into the L-shaped pockets 222*a*, 222*b*. Then push up on the rear of the forend 212. Once the forend is level, the front locks 214*a*, 214*b* and rear locks 216*a*, 216*b* will snap into place.

When the forend 212 is attached, it is held in place by four locks, two per side. Front forend lock protrusions (e.g., 223*b*) respectively engage front forend carrier lock protrusions (e.g., 220*b*) to form the front locks 214*a*, 214*b*. Spring-loaded slide bars 224*a*, 224*b* respectively engage the carrier's rear lock protrusions (e.g., 218*b*) to secure the rear locks 216*a*, 216*b*.

To remove forend 212, push both slide lock releases (e.g., 226*b*) forward. Holding those knurled releases forward, pull down the rear of the forend and then slide the forend forward and down . . . until it is off the carrier. At that point, the user can swap out another forend by reversing the process.

FIGS. 5-11 show Applicants' now-preferred embodiment 300.

While the basic concept has stayed the same, the "Easy Connect Forend" design has been improved since Applicants' parent application. Referring to the earlier embodiment 200 (see FIG. 2), the two releasable slide locks 216*a*, 216*b* have been replaced by one releasable slide lock 340 (see FIGS. 6, 9) with different structure. The components that comprised the slide locks 216*a*, 216*b* have all been removed. The removed parts included: rear lock protrusions 218*a*, 218*b* (see FIG. 4), forend slide bars 224*a*, 224*b* (see FIG. 2), and slide lock releases with springs 226*b* (see FIGS. 2, 4).

In the new embodiment 300, the releasable slide lock 340 (a.k.a. slide release) preferably comprises: a spring-loaded latch 342, extending from forend carrier 310; and a pocket or recess 344, in a new forend 312, which stores an end of the latch 342 when the forend 312 and carrier 310 are nested together. See FIG. 6.

Figure 5:
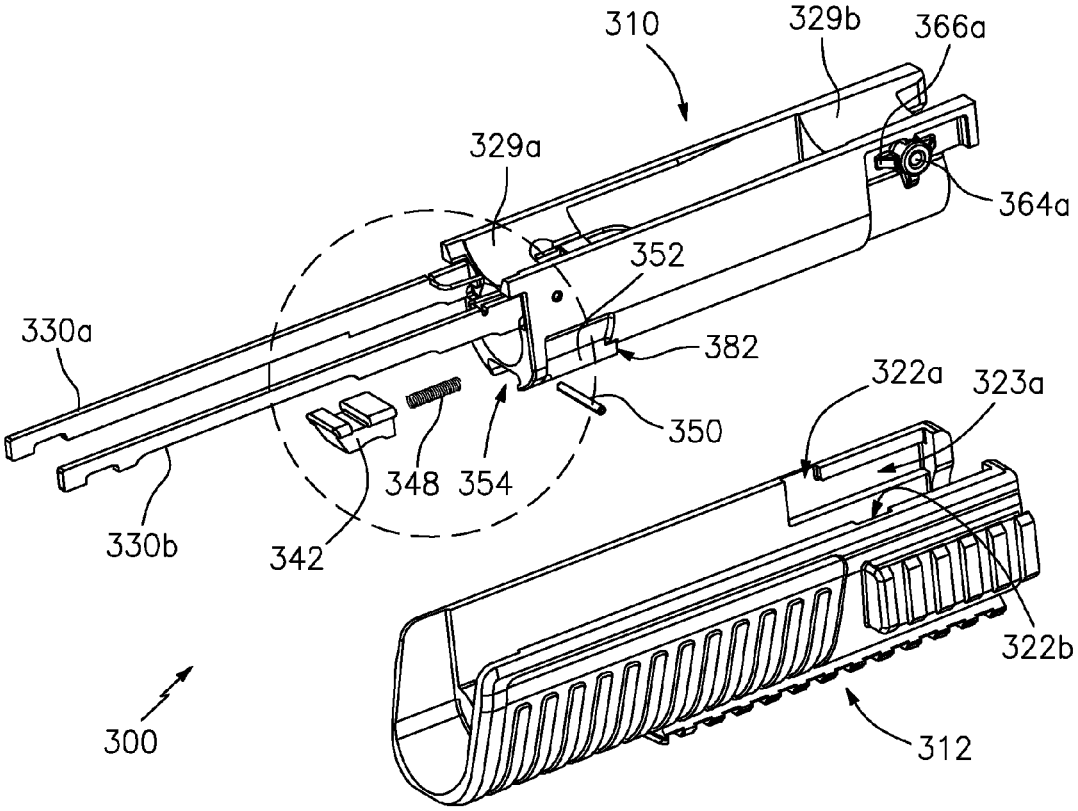
FIG. 5 is an exploded view of the forend carrier and forend forming the preferred embodiment of Applicants' "Easy Connect Forend Assembly;"
Figure 5A:
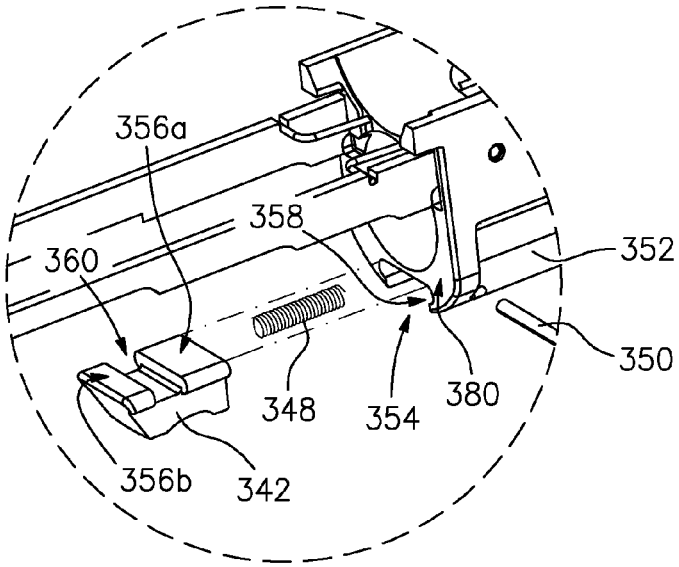
FIG. 5A is an enlarged view of an encircled portion in FIG. 5.

FIG. 5 shows an exploded view of the following components of the latch mechanism: the latch 342; a latch spring 348; and a cross pin 350. It also shows a protrusion 352, in the bottom of carrier 310, with a recessed channel 354 (see also FIGS. 5, 6A) having an open bottom.

When assembled, the latch 342 is part of carrier 310. One end of latch 342 fits into the carrier's channel 354 and is constrained vertically and laterally by its rounded protrusions 356*a*, 356*b* (i.e., preferably flat tops with rounded shoulders), which engage a correspondingly shaped surface 358 in the channel. See FIG. 5A. Another end of the latch 342 protrudes outside the carrier 310. See FIGS. 5, 11, 11A.

Latch 342 is biased outwardly by spring 348 (here, a coil spring). Cross pin 350 engages a slot 360 in the latch. Slot 360 is wide enough to allow enough travel for the latch 342 to engage and disengage the forend 312, while preventing the latch 342 from sliding out of the channel 354.

New forend 312 preferably has no moving parts, as there is no need. Latch 342 is housed by the forend carrier 310.

The "tongue-and-groove" attachment method, at the front of the prior forend 212, has not changed. However, the "front latch protrusions" (see, e.g., 220*a* in FIGS. 2, 4) are now round bosses (see, e.g., boss 364*a* FIGS. 5, 11) with reinforcing ribs (see, e.g., rib 366*a* in FIGS. 5, 11). Previously they were described as "flat on top; have flat bottoms which incline from rear to front; and, have a rounded tip." The descriptions of the forend L-shaped pockets 222*a*, 222*b* (see FIGS. 2, 4) and protrusions 223*a*, 223*b* (see FIG. 2) are still valid.

The forend 312 is attached to the carrier assembly 310 in a similar manner to the original design 200. After engaging the new carrier's front protrusions (i.e., bosses) (e.g.,364*a*) in the forend's L-shaped pockets 322*a*, 322*b* pockets, the forend 312 is slid rearwards and rotated upwards. As the forend 312 is rotated upwards, a surface 367 on a forend rib 368 cams the latch 342 back against latch spring 348. When the forend 312 reaches the horizontal position the latch 342, pushed by latch spring 348, travels into the pocket or recess 344 in the forend rib 368. The forend 312 is now fully constrained on the carrier 310. A contoured bottom of latch 342 protrudes through an opening 370 in the bottom of forend 312.

Figure 6:
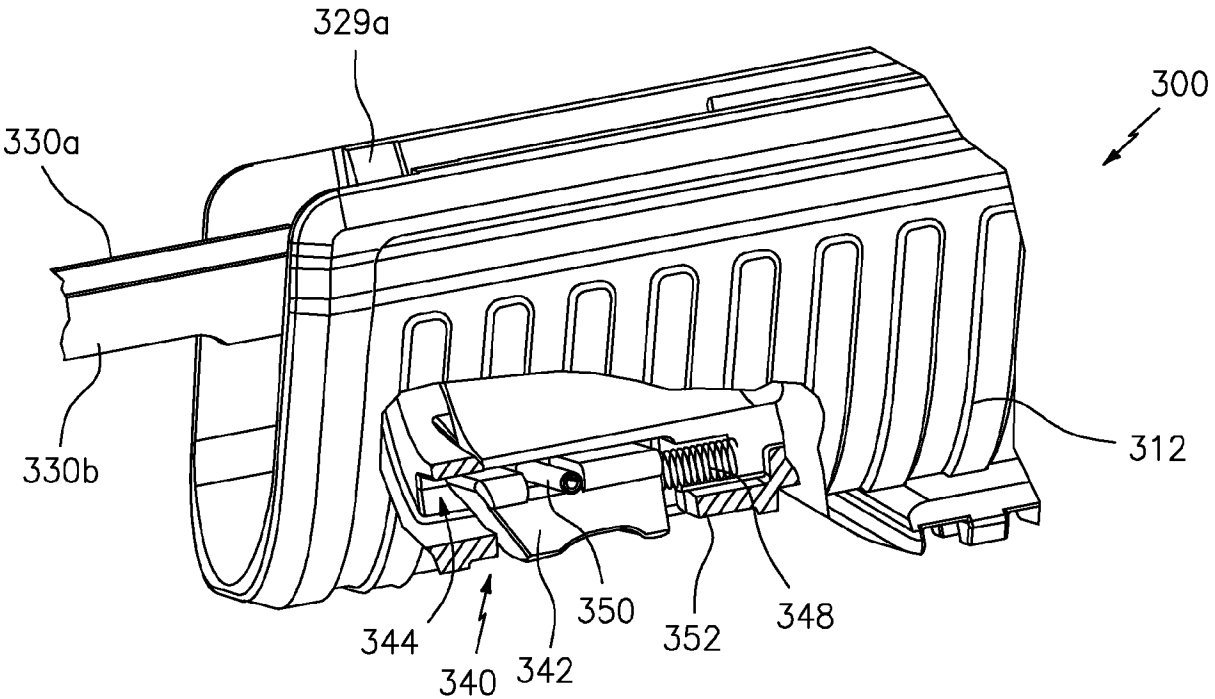
FIG. 6 is a top perspective view of that preferred carrier and forend assembly, nested together, with portions broken away for clarity.
Figure 7:
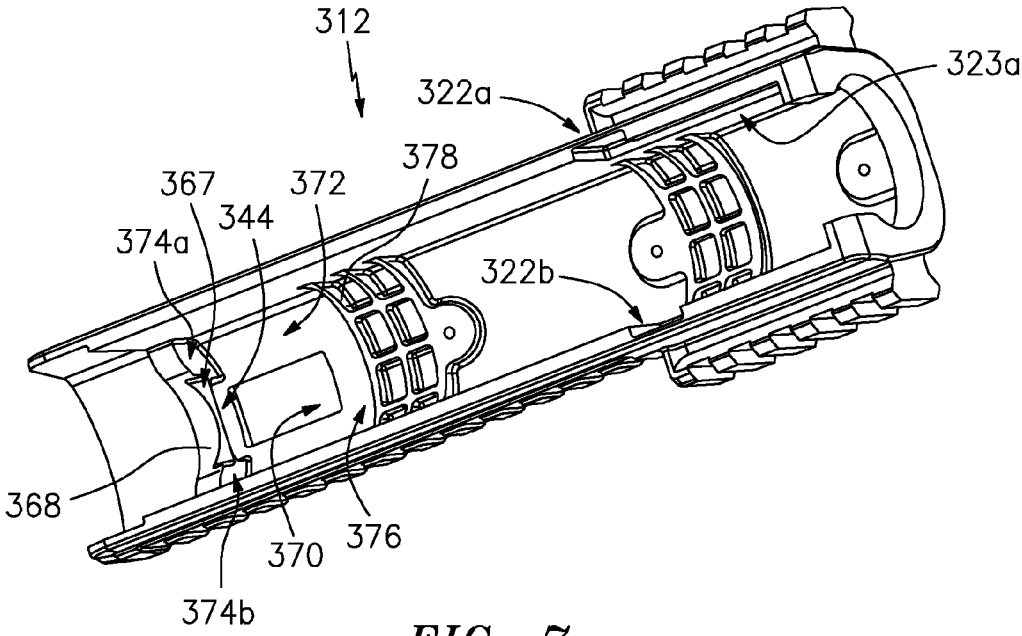
FIG. 7 is a top perspective view looking into Applicants' preferred forend.
Figure 8:
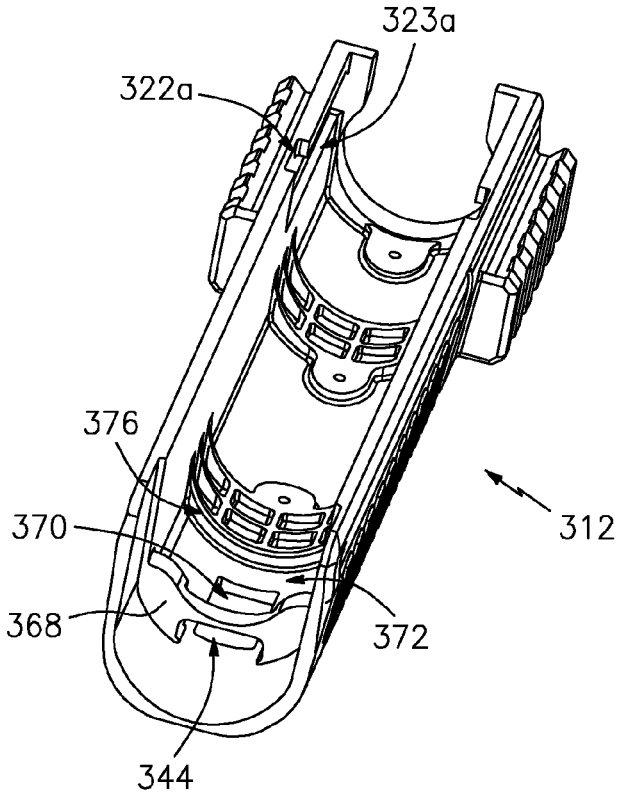
FIG. 8 is an end perspective view also looking into Applicants' preferred forend.
Figure 9:
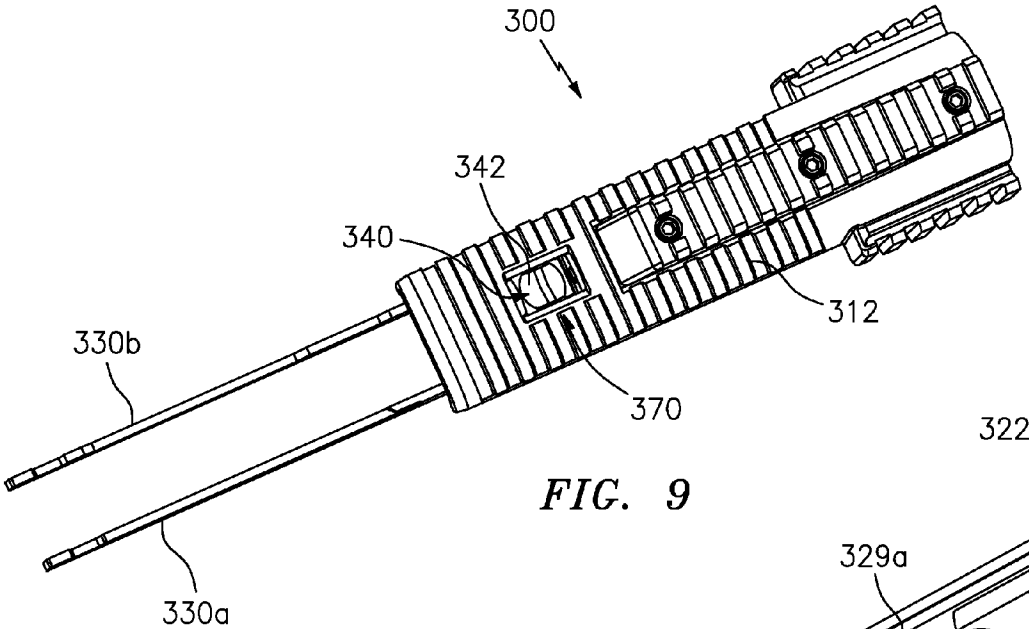
FIG. 9 is a bottom perspective view of the preferred carrier and forend assembly, nested together.
Figure 10:
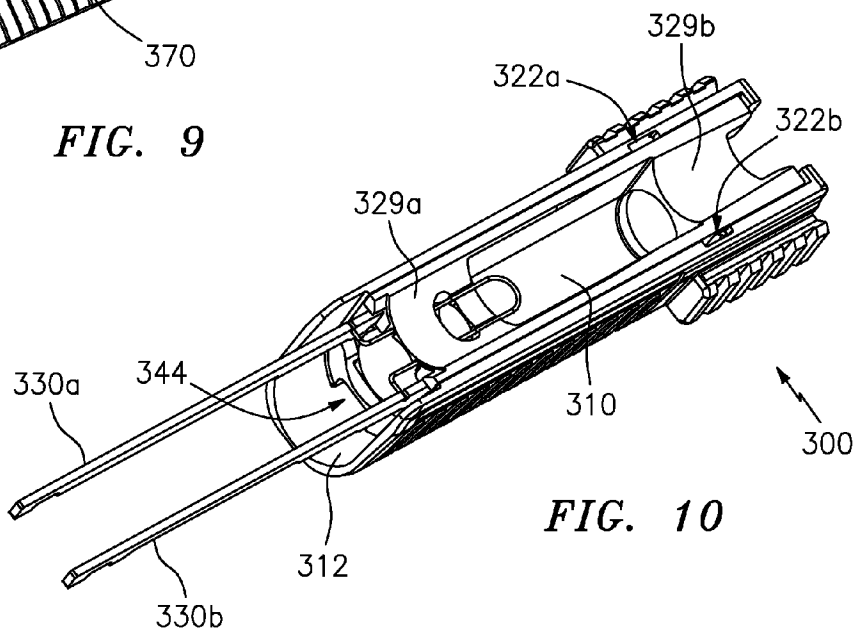
FIG. 10 is a top perspective view of the preferred carrier and forend assembly, nested together.
Figure 11:
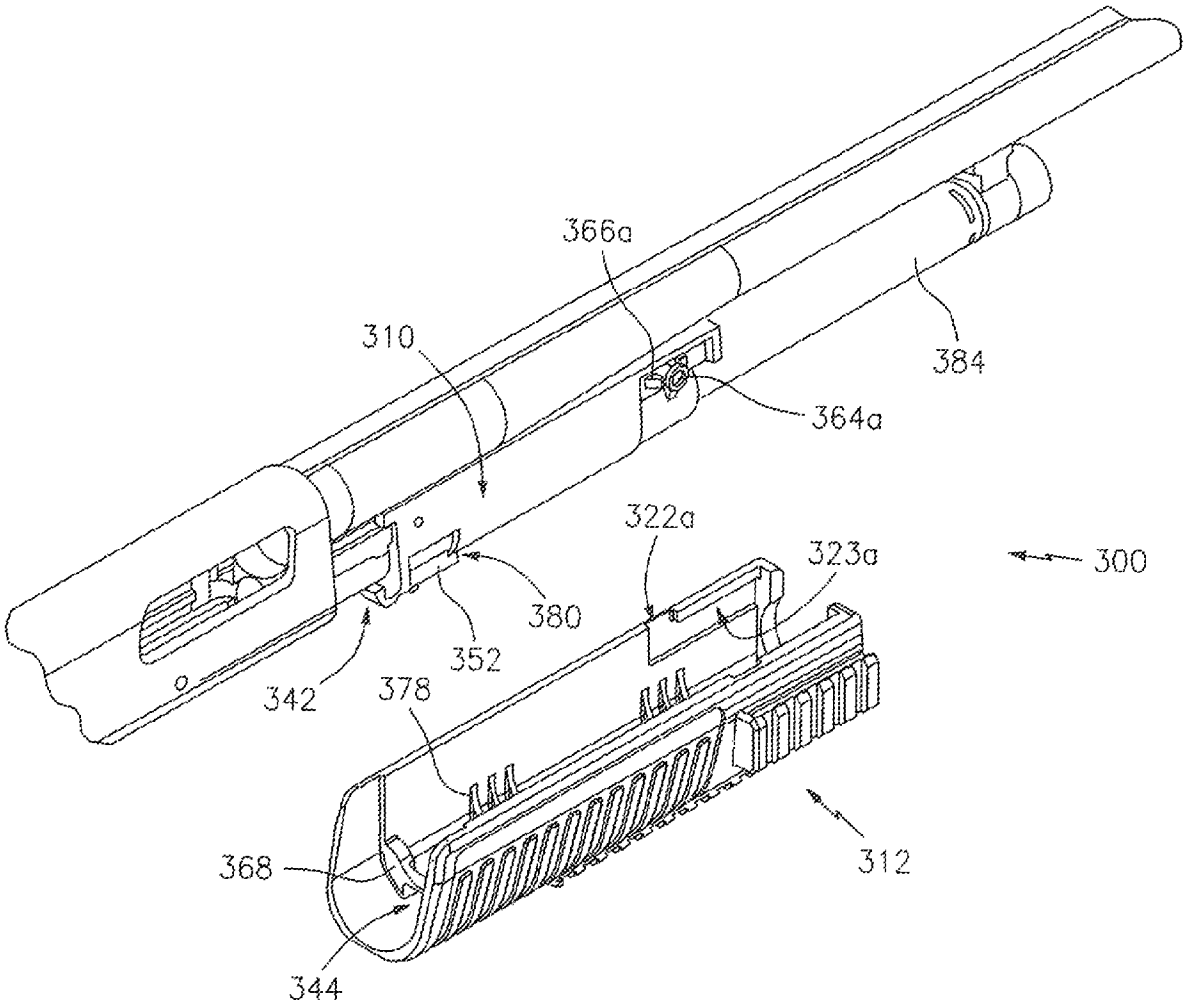
FIG. 11 is a perspective view of Applicants' preferred forend carrier affixed to the front end of a shotgun, with the forend removed.

FIG. 6 shows the latch 342 engaging the forend 312. FIGS. 7, 8 best show the interior of forend 312, including surface 367, rib 368, and opening 370.

To remove the forend 312, the latch 342 is slid back against spring 348 and the forend 312 is rotated downwards. When the forend rib 368 clears the latch 342, the forend is pushed forward and removed.

When the forend 312 is mounted on the carrier assembly 310, protrusion 352 on the carrier 310 fits snuggly into a recess 372 in the forend. Recess 372 is formed by surfaces 374*a*, 374*b* on rib 368 and surface 376 on another forend rib 378 (see FIGS. 7, 8). The carrier protrusion 352 has two ends with surfaces 380, 382. When the forend is pulled backwards to open the gun action, forend surface 376 pushes on carrier surface 382. When the forend is pushed forward to close the gun action, surfaces 374*a*, 374*b* push on carrier surface 380.

The carrier assembly 310 slides over the shotgun magazine tube 384 (see FIG. 11), just like a conventional forend tube. Orientation is maintained by the action bars 330*a*, 330*b* (see FIG. 5), which engage in a standard manner the bolt slide (not shown) in the receiver.

Bearing blocks 329*a*, 329*b* of the carrier 310 (see FIGS. 5, 10) are contoured to provide clearance on the barrel 390 as the carrier assembly 310 traverses forwards and backward. The bearing blocks 329*a*, 329*b* (see FIG. 10) support the carrier assembly 310 on the magazine tube 384.

O.F. Mossberg & Sons, Inc. currently manufactures Applicants' preferred forend assembly embodiment 300 in conjunction with an improved "Easy Connect Stock" disclosed in U.S. patent application Ser. No. 12/625,785, for "METHOD AND APPARATUS FOR EASY CONNECT STOCKS", filed Nov. 25, 2009. That application was published on Jun. 3, 2010.

Applicants' forend assembly embodiments 200, 300 therefore are designed to be used in the field or anywhere, allowing the user with quickness and ease to change out a forend (e.g., 212, 312) without the use of tools. No tools are needed to replace an "Easy Connect Forend" (e.g., 212, 312) after its associated forend carrier (e.g., 210, 310) is mounted onto the shotgun by tools beforehand.

Each of Applicants' forend assembly embodiments 200, 300 can be thought of as a tool-less means for (selectively) removably attaching the forend onto or removing the forend off a fixed carrier. For example, the combination of a tongue-and-groove arrangement (e.g., 214*b*, 314*b*) and a releasable lock (e.g., slide lock 216*b*, slide lock 340) can be thought of as a tool-less means for easily connecting or disconnecting a forend in a long gun.

Applicants' invention allows for easy adjustment and reduction in time when interchanging the forend (e.g., 212, 312) for different users and/or different types of game or sporting activities.

Applicants' preferred embodiment is used with the "Easy Connect Stock" assembly shown in In its broadest sense, Applicant's invention can be thought of as a method for removably attaching the forend onto or removing the forend off a fixed carrier of a long gun, comprising:

a. sliding a forend onto a forend carrier secured to a long gun;
b. removably locking the forend in place without the use of tools; and
c. unlocking the forend, and removing it off the carrier, without the use of tools.

More narrowly, Applicants' preferred method comprises:

a. attaching a forend onto a fixed forend carrier, of a long gun, by a tongue-and-groove arrangement in the carrier and forend;

b. removably securing the forend, in place, to the carrier by a releasable lock located at least in part in the carrier; and c. wherein steps (a) and (b) are performed without the use of tools by a user in the field.

It should be understood by those skilled in the art that obvious structural modifications can be made to the Easy Connect Forend Assembly, beyond those noted above, without departing from the spirit of the invention. Accordingly, reference should be made primarily to the accompanying claims rather than the foregoing description to determine the scope of the invention.

Having thus described the invention, we claim:

1. A method for removably attaching a forend in a pump action shotgun comprising:

a. affixing a forend carrier having at least one action bar to the pump action shotgun;

b. attaching a front end of the forend by a tongue-and-groove arrangement in the carrier and forend;

c. removably securing the forend, in place, to the carrier by a releasable lock located at least in part in the carrier; and d. wherein steps (b) and (c) are performed without the use of tools by a user in the field.

2. A method for removably attaching a forend in a long gun comprising:

a. affixing forend carrier to the long gun:

b. attaching a front end of the forend by a tongue-and-groove arrangement in the carrier and forend;

c. removably securing the forend, in place, to the carrier by a releasable lock located, at least in the forend, in the forend;

d. wherein the step of removably securing the forend, in place, to the carrier by a releasable lock located, at least in part, in the forend further comprises the following sub-steps:

i. spring loading a pair of slide bars on opposite sides of the interior of the forend, adjacent a rear end of the forend; and ii. sliding those bars over respective protrusions on the carrier;

e. wherein steps (b) and (c) are performed without the use of took by a user in the field.

3. The method of claim 2 wherein the step of removably attaching the forend by the tongue-and-groove arrangement further comprises the following sub-steps:

a. slipping grooves in a front end of the forend over respective protrusions in a front end of the carrier, while holding the forend in a downward tilt relative to the carrier; and b. pivoting a rear end of the forend upwardly, towards the carrier, until a releasable lock in the forend snaps into place.

4. A method comprising:

a. attaching a forend onto a fixed forend carrier of a pump action shotgun by a tongue-and-groove arrangement in the carrier and forend, the forend carrier having at least one bar;

b. removably securing the forend, in place, to the carrier by a releasable lock located, at least in part, in the carrier; and c. wherein steps (a) and (b) are performed without the use of tools by a user in the field.

5. The method of claim 4 further comprising:

a. releasing the releasable lock without the use of tools, and b. removing the forend off the carrier without the use of tools.

6. A method comprising:

a. sliding a forend onto a forend carrier secured to a pump action shotgun, the forend carrier having at least one action bar;

b. removably locking the forend in place, by a releasable lock contained at least in part in the carrier,without the use of tools; and c. unlocking the lock, when desired for removal of the d off the carrier, without the use of tools.

7. A method for removably thing a forend in a pump action shotgun comprising:

a. affixing a forend carrier having at least one action bar to the pump action shotgun;

b. attaching a front end of the forend by a tongue-and-groove arrangement in the carrier and forend;

c. removably securing the forend, in place, to the carrier by a releasable lock contained at least in part in the carrier; and d. wherein steps (b) and (c) are performed, without the use of tools by a user in the field.

8. An apparatus comprising:

a. a pump action shotgun having a fixed forend carrier having at least one action bar;

b. a forend; and c. tool-less means for removably attaching the forend onto the carrier and removing the forend off the carrier without the use of tools; wherein the tool-less means is contained at least in part in the carrier.

9. The apparatus of claim 8 wherein the tool-less means comprises a tongue-and-groove arrangement and a releasable lock.

10. The apparatus of claim 8 wherein the tool-less means comprises a tongue-and-groove arrangement, a latch, and pushbutton release.

11. An apparatus comprising:

a. a forend carrier having at least one action bar and affixed to a pump action shotgun;

b. a forend; and c. tool-less means for selectively attaching the forend onto the carrier or removing the forend off the carrier, without the use of tools;

d. wherein the tool-less means comprises:

i. a tongue-and-groove arrangement in the forend and carrier, and ii. a releasable lock contained, at least in part, in the carrier.

* * * * *

UNITED STATES PATENT AND TRADEMARK OFFICE

CERTIFICATE OF CORRECTION

PATENT NO. : 8,522,468 B2
APPLICATION NO. : 12/948048
DATED : September 3, 2013
INVENTOR(S) : Kevin A. Webber et al.

It is certified that error appears in the above-identified patent and that said Letters Patent is hereby corrected as shown below:

In the Claims

In Claim 2a., Column 7, line 29, after "affixing" insert --a--.

In Claim 2c., Column 7, line 33, change "the forend" to --part--.

In Claim 2e., Column 7, line 45, change "took" to --tools--.

In Claim 4a., Column 7, line 60, after "one" insert --action--.

In Claim 6c., Column 8, line 18, after "desired" insert --,-- and change "d" to --forend--.

In Claim 7, Column 8, line 20, change "thing" to --attaching--.

In Claim 7d., Column 8, line 30, delete ",".

Signed and Sealed this
Fifth Day of November, 2013

Teresa Stanek Rea

Teresa Stanek Rea
*Deputy Director of the United States Patent and Trademark Office*